US006755145B2

(12) United States Patent
Bolebruch

(10) Patent No.: US 6,755,145 B2
(45) Date of Patent: Jun. 29, 2004

(54) KAYAK PADDLE HOLDER AND COCKPIT TRAY

(76) Inventor: Jeffrey J. Bolebruch, 217 Hillview Rd., Gloversville, NY (US) 12078

( * ) Notice: Subject to any disclaimer, the term of this patent is extended or adjusted under 35 U.S.C. 154(b) by 0 days.

(21) Appl. No.: 10/307,299

(22) Filed: Dec. 2, 2002

(65) Prior Publication Data

US 2004/0103838 A1 Jun. 3, 2004

(51) Int. Cl.[7] ..... B63B 35/00
(52) U.S. Cl. ..... 114/347
(58) Field of Search ..... 114/343, 347, 114/364; 440/101, 104; 108/44; D7/552.1, 552.2; D12/419; 224/539, 540, 558, 560

(56) References Cited

U.S. PATENT DOCUMENTS

D187,077 S * 1/1960 Labe ..... D7/552.1
2,934,385 A * 4/1960 Rees ..... 108/44
3,140,069 A 7/1964 McBurney et al.
D208,317 S * 8/1967 Broder ..... D7/552.1
4,634,089 A * 1/1987 Wright et al. ..... 248/311.2
4,739,720 A 4/1988 Jarschke
4,846,382 A * 7/1989 Foultner et al. ..... 224/483
5,996,527 A 12/1999 Ambrozic
6,027,387 A * 2/2000 Allin ..... 440/104
6,035,799 A * 3/2000 Lukanovich et al. ..... 114/343
6,050,213 A 4/2000 Stevens
6,092,776 A * 7/2000 You ..... 248/311.2
6,435,126 B1 * 8/2002 Burke ..... 114/363
6,581,538 B2 * 6/2003 Sorensen ..... 114/343
6,632,111 B2 * 10/2003 Oathout ..... 440/104

* cited by examiner

*Primary Examiner*—Andrew Wright
(74) *Attorney, Agent, or Firm*—Richard C. Litman

(57) ABSTRACT

A tray which is easily attached to the rim of the cockpit of a kayak. The top surface of the tray is provided with recessed compartments for retaining various items therein. At least one recess is designed to retain a standard-sized beverage container. A clamp, formed on the tray, is designed to securely retain the kayak's paddle thereby freeing the rower's hands when desired. The tray is fabricated from molded plastic or a hard rubber.

7 Claims, 3 Drawing Sheets

KAYAK PADDLE HOLDER AND COCKPIT TRAY

BACKGROUND OF THE INVENTION

1. Field of the Invention

The present invention relates to water craft accessories. More specifically, the present invention is drawn to an attachment for a kayak, which attachment is adapted to retain a paddle and other desired items.

2. Description of the Related Art

The touring kayak is configured to accommodate one or two persons. The basic design of the kayak does not include available storage space, thus a participant(s) is somewhat limited in the types of supplementary equipment and amenities that can be transported. Presently supplementary equipment is stored in water proof bags which are lashed to the deck of the kayak with elastic bungee cords. This system is less than satisfactory, especially for the for the touring kayaker who would prefer to have ready access to amenities such as cameras, radios, refreshments, etc. Further, there is no adequate place to store the kayak paddle when the kayaker desires to have both hands free. A kayak accessory which would allow for paddle storage and also provide for the placement of amenities such as beverage containers, cameras, etc. would surely be a welcome addition to the art.

U.S. Pat. No. 4,739,720 (Jarschke), U.S. Pat. No. 5,996,527 (Ambrozic) and U.S. Pat. No. 6,050,213 (Stevens) appear to be the most pertinent references uncovered in the search of the prior art.

The Jarschke patent is drawn to pack adapted to be positioned on the deck of a kayak immediately in front of the paddler. The pack must be accessed by opening a zippered flap.

The Ambrozic patent discloses structure for holding fishing rods on a kayak deck. There is no indication that a paddle or paraphernalia could be supported on the structure.

The Stevens patent shows a device temporarily secured to the deck of a kayak, said device adapted to hold a standard sized beverage container. The device does not appear to be able to hold items other than the beverage container.

U.S. Pat. No. 3,140,069 (Mcburney et al.) is drawn to a fishing pole holder adapted to be attached to the gunwale of a boat. The holder is attached to the gunwale with screws. There is no intention that the apparatus retain any object other than a fishing pole.

None of the above inventions and patents, taken either singularly or in combination, is seen to disclose a kayak paddle holder and tray as will be subsequently disclosed and claimed in the instant invention.

SUMMARY OF THE INVENTION

The present invention is drawn to a tray which is easily attached to the rim of the cockpit of a kayak. The top surface of the tray is provided with recessed compartments for retaining various items therein. Items such as cameras, cell-phones, compasses, snacks, etc. may be retained in the compartments for easy access thereto. At least one recess is designed to retain a standard-sized beverage container. A clamp, formed on the tray, is designed to securely retain the kayak's paddle thereby freeing the rower's hands when desired. In its preferred form, the tray is fabricated from molded plastic and is inexpensive to manufacture.

Accordingly, it is a principal object of the invention to provide a storage accessory for a touring kayak.

It is another object of the invention to provide a storage accessory for a touring kayak, which accessory is easily accessed from the cockpit of the kayak.

It is a further object of the invention to provide a storage accessory for a touring kayak, which accessory is easily attached to the cockpit of the kayak.

Still another object of the invention is to provide an accessory for a touring kayak, which accessory is designed with plural recessed compartments and a clamp for retaining a paddle.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
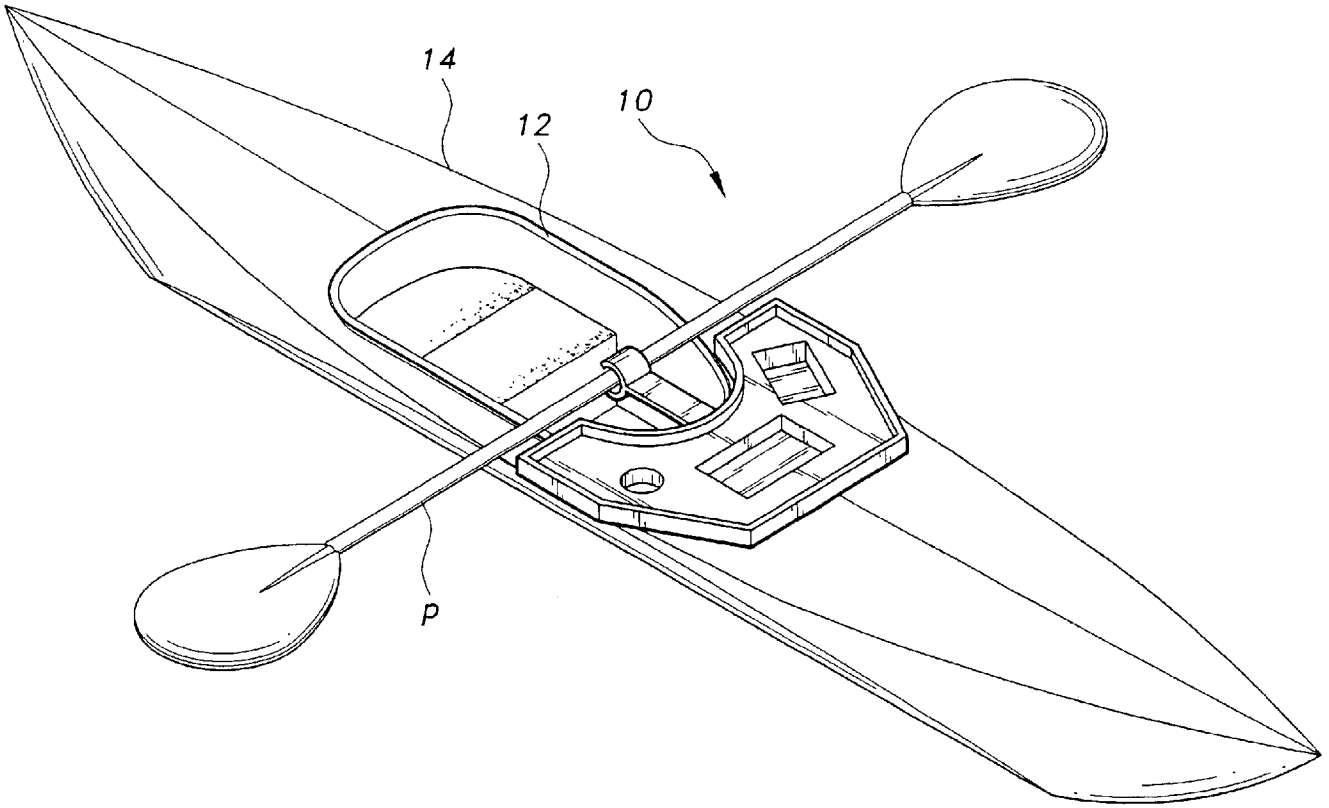
FIG. 1 is an environmental, perspective view of a kayak paddle holder and cockpit tray according to the present invention.
Figure 2:
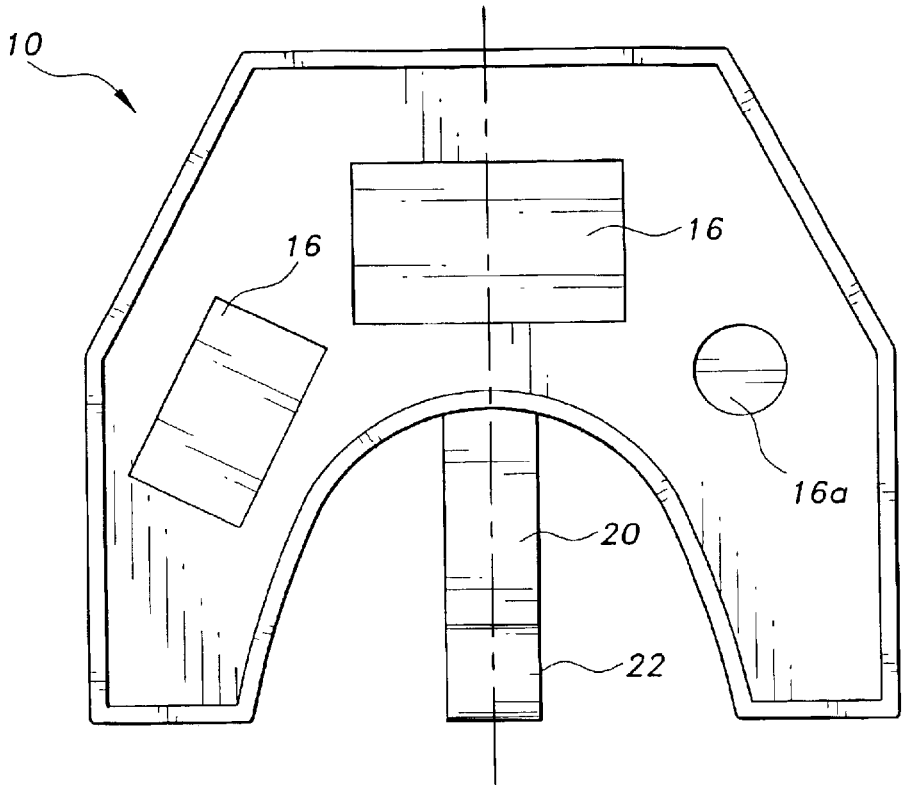
FIG. 2 is a top view of a kayak paddle holder and cockpit tray according to the present invention.
Figure 3:
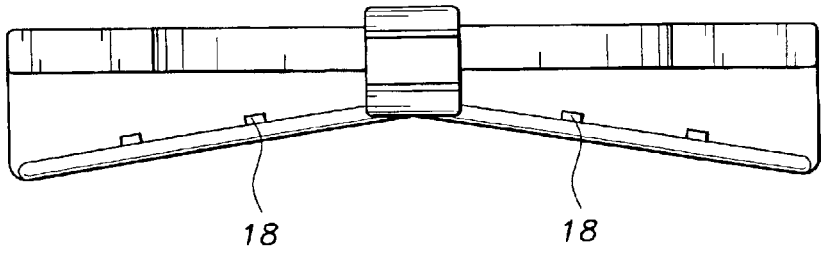
FIG. 3 is a rear view of a kayak paddle holder and cockpit tray according to the present invention.

Attention is first directed to FIG. 1 wherein the paddle holder and cockpit tray of the present invention is generally indicated at 10. Tray 10 is mounted to the rim 12 of the cockpit of a kayak 14. As best seen in FIG. 2, a plurality of recessed portions 16 are formed in the top surface of tray 10. As indicated above, recessed portions 16 are adapted to retain desired paraphernalia within easy access to the kayaker. At least one recessed portion 16*a*, is dimensioned to retain a standard-sized beverage container. The bottom surface of tray 10 (FIG. 3) is provided with pads 18 thereon of different thickness. The pads have adhesive thereon to effect quick and easy attachment to the deck of the bottom surface of the tray. The pads are fabricated from non-skid material. The bottom surface of the tray is angled downwardly (on two sides) from the central axis of the tray so that the tray bottom surface substantially conforms to the contour of the kayak deck. The kayaker could select a pad of appropriate thickness to enhance the tray's conformance with the deck of the kayak.

Figure 4:
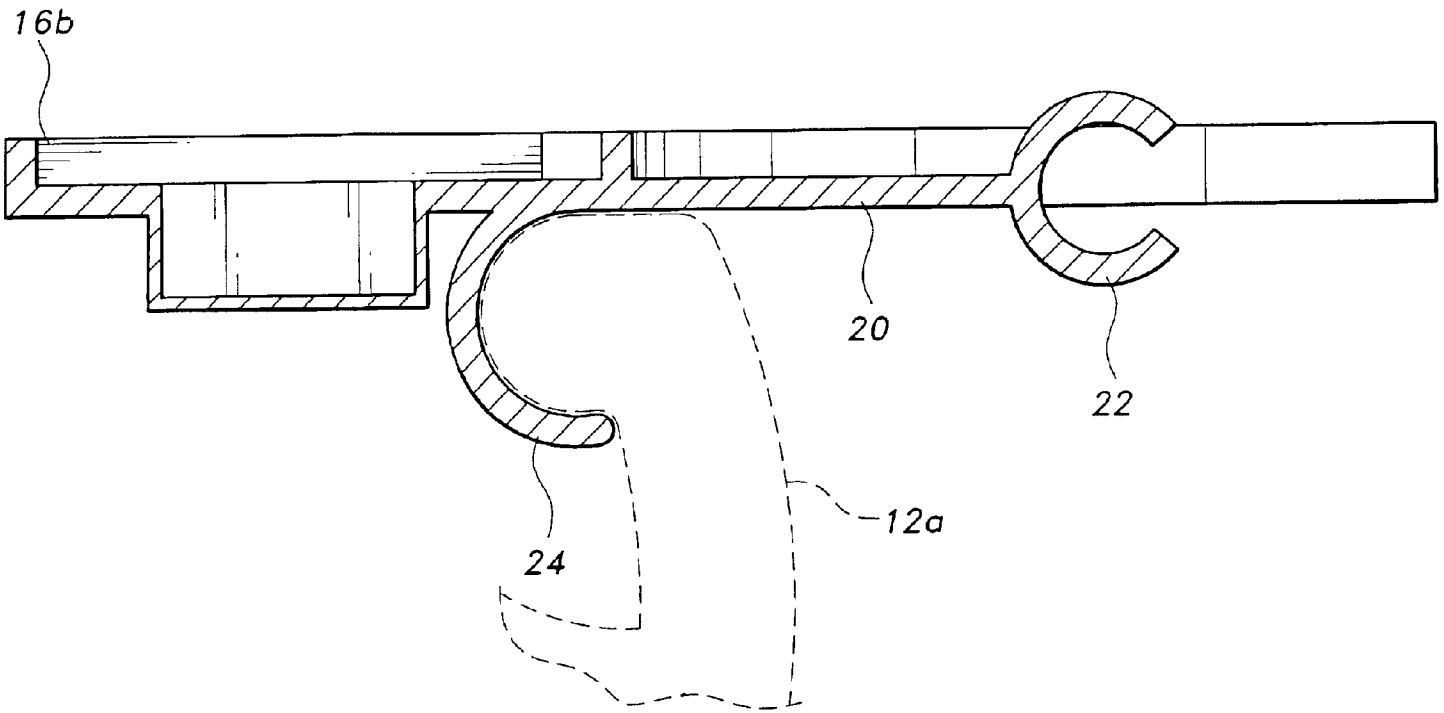
FIG. 4 is a partial, sectional view of a kayak paddle holder and cockpit tray according to the present invention.

As best illustrated in FIG. 4, a member 20 extends from the rear edge of tray 10 and terminates in a free end. Member 20 is coincident with the central axis of the tray. An arcuate-shaped clamp 22 defines the free end. Clamp 22 is adapted to retain a paddle P as shown in FIG. 1. A clip 24 is disposed on the under surface of member 20 approximately midway the length thereof. Clip 24 is adapted to fit under the lip 12*a* of the cockpit rim.

In its preferred form, the tray is fabricated from molded plastic. It should be noted, however, that a hard rubber could also be utilized. To ensure a pleasing aesthetic appearance, the tray is configured to conform to the lines of the kayak. The tray is provided with rim 16*b* to prevent the retained items from easily slipping from the tray.

It is to be understood that the present invention is not limited to the embodiment described above, but encompasses any and all embodiments within the scope of the following claims.

What is claimed is:

1. The combination of a kayak and an accessory therefor, said kayak having a deck and a cockpit therein, said combination comprising:

a rim defining a perimeter of said cockpit;

a lip portion disposed on said rim;

a tray, said tray having a top surface, a bottom surface, a center axis and a rear edge;

an array of recesses disposed in said top surface of said tray;

said bottom surface angled downwardly from said center axis and positioned on said deck;

an elongate member extending from said rear edge of said tray, wherein said elongate member terminates in a free end; and an arcuate-shaped clamp defining said free end of said elongate member, whereby said clamp is adapted to receive and retain a paddle.

2. The combination of a kayak and an accessory therefor as recited in claim 1, including a plurality of adhesive pads disposed on said bottom surface for securing said bottom surface to said deck.

3. The combination of a kayak and an accessory therefor as recited in claim 1, wherein said elongate member has an underside and wherein an arcuate clip is disposed on said underside in engagement with said lip.

4. The combination of a kayak and an accessory therefor as recited in claim 3, wherein said elongate member is coincident with said center axis of said tray.

5. The combination of a kayak and an accessory therefor as recited in claim 1, wherein at least one of said array of recesses is adapted to receive a beverage container.

6. The combination of a kayak and an accessory therefor as recited in claim 1, wherein said tray is fabricated from plastic material.

7. The combination of a kayak and an accessory therefor as recited in claim 1, wherein said tray is fabricated from hard rubber.

* * * * *